United States Patent [19]

Elder

[11] 4,042,165

[45] Aug. 16, 1977

[54] REINFORCED PAPERBOARD BOX

[75] Inventor: Jerome Earl Elder, Minneapolis, Minn.

[73] Assignee: International Paper Company, New York, N.Y.

[21] Appl. No.: 622,087

[22] Filed: Oct. 14, 1975

[51] Int. Cl.[2] ..... B65D 5/28

[52] U.S. Cl. ..... 229/33; 229/16 A; 229/DIG. 4

[58] Field of Search ..... 229/32, 33, 36, 16 A, 229/16 R

[56] References Cited

U.S. PATENT DOCUMENTS

| | | | |
|---|---|---|---|
| 1,014,951 | 1/1912 | Cornell | 229/33 |
| 1,616,014 | 2/1927 | Walter | 229/33 |
| 1,699,008 | 1/1929 | Miller | 229/DIG. 4 |
| 2,162,169 | 6/1939 | Grossman | 229/36 |
| 2,165,023 | 7/1939 | Aull | 229/33 |
| 2,524,441 | 10/1950 | Guyer | 229/16 A |
| 2,858,058 | 10/1958 | Kitchell | 229/33 |
| 3,038,650 | 6/1962 | Asman | 229/33 |
| 3,039,670 | 6/1962 | Hardon | 229/27 |
| 3,193,176 | 7/1965 | Gullickson | 229/33 X |
| 3,396,897 | 8/1968 | Bick et al. | 229/16 R |
| 3,534,900 | 10/1970 | Hutchins | 229/33 |
| 3,539,089 | 11/1970 | Osberg | 229/33 X |
| 3,658,234 | 4/1972 | Deckys | 229/31 FS |
| 3,727,824 | 4/1973 | Giebel | 229/16 R |
| 3,854,651 | 12/1974 | Osborne | 229/16 R X |
| 3,899,123 | 8/1975 | Stollberg et al. | 229/DIG. 4 |
| 3,904,106 | 9/1975 | Elder | 229/31 R |

*Primary Examiner*—Davis T. Moorhead
*Attorney, Agent, or Firm*—Ronald A. Schapira

[57] ABSTRACT

A reinforced paperboard box for cut-up meat and the like and the blank for forming the box. The box includes the following conventional elements: a bottom panel; a pair of upstanding side wall panels, connected to opposite edges of the bottom panel; a pair of upstanding end wall panels connected to opposite edges of the bottom panel; a pair of upstanding side wall reinforcing flaps, each of which is connected to an upstanding edge of one of the end wall panels and is located inwardly of a side wall panel; a pair of upstanding end wall reinforcing flaps, each of which is connected to an upstanding edge of one of the side wall panels and is located outwardly of an end wall panel; a pair of side closure flaps, each connected to the upper edge of one of the side wall panels; and a pair of end closure flaps, each connected to the upper edge of one of the end wall reinforcing flaps. The box features a pair of support tabs, connected along a cut fold line to the upper edges of the end wall panels. The support tabs are adapted to underlie and hold up the end closure flaps when the side closure flaps are pressed downwardly against underlying portions of the end closure flaps to adhesively bond these flaps together and, thereby, close the box.

3 Claims, 9 Drawing Figures

REINFORCED PAPERBOARD BOX

BACKGROUND OF THE INVENTION

This invention relates to a one-piece reinforced paperboard box construction for cut-up meat, such as red meat, poultry and fish. This invention particularly relates to a reinforced box for relatively large quantities of meat, i.e., about 60 to 90 pounds. This invention is quite particularly concerned with a box for large pieces of cut-up meat, such as pork loins and pork butts.

One-piece paperboard box constructions for packaging large quantities of cut-up meat and the like are known in the art. Generally, such boxes are fabricated from a suitably cut and scored, corrugated paperboard material. Typically, the paperboard material is treated on one or both of its surfaces with a moisture and grease resistant barrier material, such as polyethylene. Also, in many cases, the boxes are provided with reinforced end and side walls, formed by multiple thicknesses of paperboard material.

However, the heretofore available reinforced box constructions for cut-up meat have not been entirely satisfactory for use in large scale meat packing operations. The boxes generally have not been well adapted to be set-up, filled with various size pieces of cut-up meat, and closed using adhesive materials on automatic high-speed machinery.

In particular, securely machine closing these boxes with adhesives has posed significant difficulties where large and irregular size pieces of meat are to be packed. It has not been possible, using automatic equipment, to assure that the boxes are filled to the top before being closed. As a result, the boxes frequently have not been filled to the top. The chief problem in closing such boxes, when not filled, has been in providing sufficient pressure between their closure flaps to adhesively bond the closure flaps together.

There has been a need, therefore, for a simple reinforced container construction which can be adhesively closed, even when not filled, and which is compatible with modern, high volume, meat packing operations.

SUMMARY OF THE INVENTION

In accordance with this invention, in a paperboard box having reinforced end walls, formed from: a bottom panel; a pair of upstanding side walls panels, connected to opposite edges of the bottom panel; a pair of upstanding end wall panels, connected to opposite edges of the bottom panel; a pair of upstanding end wall reinforcing flaps, each connected to an upstanding edge of one of the side wall panels and located either inwardly or outwardly of one of the end wall panels; a pair of side closure flaps, each connected to the upper edge of one of the side wall panels and being disposed substantially perpendicular to a side wall panel; and a pair of end closure flaps, each connected to the upper edge of either an outwardly located end wall panel or an outwardly located end wall reinforcing flap and being disposed substantially perpendicular to an end wall panel; the improvement is provided, which comprises:

- a pair of support tabs, each connected to the upper edge of either an inwardly located end wall panel or an inwardly located end wall reinforcing flap, underlying an end closure flap, and being disposed substantially perpendicular to an end wall.

This box has a simple reinforced construction. It is well suited to be assembled, filled with relatively heavy quantities and large pieces of cut-up meat, and closed with an adhesive, even when not filled to the top, on automatic equipment. The box is also sufficiently strong to be stored and shipped in a stack, as required by modern, high volume, meat packing plants.

DETAILED DESCRIPTION OF THE INVENTION

Figure 1:
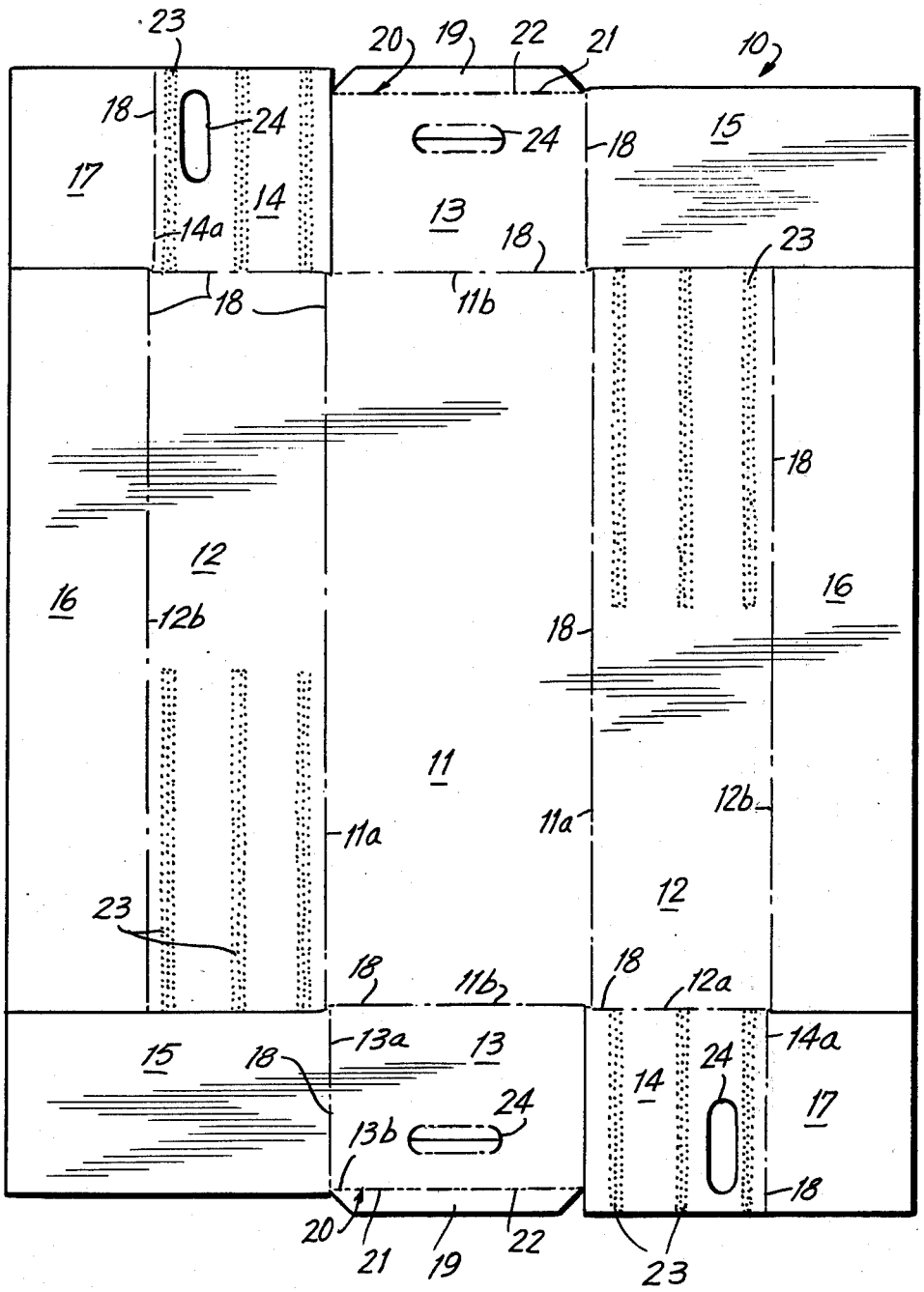
FIG. 1 is a plan view of a paperboard blank, which can be formed into the reinforced box of this invention.
Figure 8:
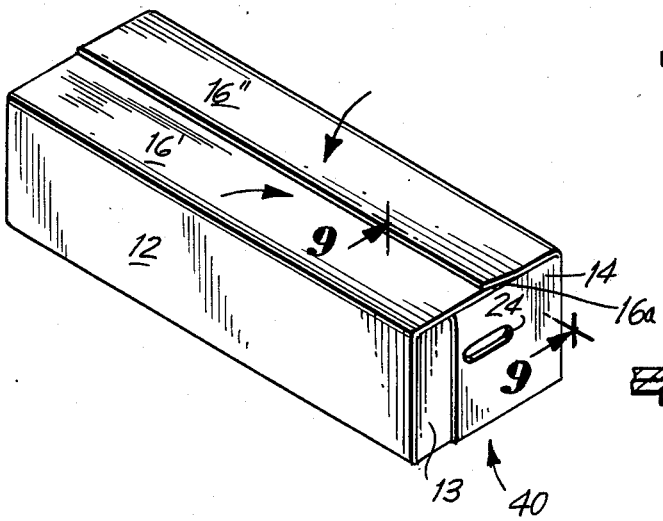
FIG. 8 is a perspective view of the closed reinforced box of this invention.

Shown in FIG. 1 is a cut and scored, generally rectangular paperboard blank 10. The flaps and panels of blank 10 can be folded and adhesively bonded together, using automatic equipment, to form an open reinforced box 30, a shown in FIG. 5, and a closed reinforced box 40, as shown in FIG. 8, for cut-up meat, in accordance with this invention.

The blank 10 includes a generally rectangular bottom panel 11. Foldably connected to opposite sides or edges 11*a* of the bottom panel 11 are a pair of generally rectangular side wall panels 12. A pair of generally rectangular end wall panels 13 are foldably connected to the other opposite edges 11*b* of the bottom panel 11. The blank 10 also includes a pair of generally rectangular end wall reinforcing flaps 14 at opposite corners of blank 10, each of which is foldably connected to a lateral edge 12*a* of a side wall panel 12 and is disposed between a side wall panel 12 and an end wall panel 13. The blank 10 further includes a pair of generally rectangular side wall reinforcing flaps 15 at the other opposite corners of blank 10, each of which is foldably connected to a lateral edge 13*a* of an end wall panel 13 and is disposed between a side wall panel 12 and an end wall panel 13.

Foldably connected to the outer edge 12*b* of each side wall panel 12 remote from the bottom panel 11 is a generally rectangular side closure flap 16. Foldably connected to the outer edge 14*a* of each wall reinforcing flap 14 remote from the adjacent end wall panel 13 is a generally rectangular end closure flap 17.

The pair of side wall panels 12 and the pair of end wall panels 13 are connected to the edges 11*a* and 11*b* of the bottom panel 11 along fold lines 18. The pair of end wall reinforcing flaps 14 are connected to lateral edges 12*a* of the side wall panels 12 and the pair of side wall reinforcing flaps 15 are connected to the lateral edges 13*a* of the end wall panels 13 also along fold lines 18. The side closure flaps 16 are connected to the outer edges 12*b* of side wall panels 12 and the end closure flaps 17 are connected to the outer edges 14*a* of end wall reinforcing flaps 14 further along fold lines 18. In accordance with this application, the fold lines 18 preferably comprise conventional scored fold lines. The fold lines 18 are adapted to permit the flaps and panels of blank 10 to be rotated relative to one another about the fold lines when assembling open box 30 from blank 10 and when closing box 30 to form closed box 40 on automatic equipment.

The blank 10, as described above, includes only conventional elements for a reinforced, generally rectangular paperboard box.

However, in accordance with this application, the blank 10 is provided with a pair of novel support tabs 19. Preferably, as seen in FIG. 1, each support tab 19 is connected to an end wall panel 13 along the outer edge 13*b* thereof remote from the bottom panel 11. Alternatively, in blank 10, the support tabs 19 can be connected instead to the end wall reinforcing flaps 14, along the outer edges 14*a* thereof, in place of the end closure flaps 17. In such a blank, the end closure flaps 17 would be provided on the outer edges 13*b* of the end wall panels 13, and the assembly of the box 30 from blank 10 would be slightly modified.

In the blank of this application, the dimensions of the support tabs 19 are not critical. Preferably, as shown in FIG. 1, the support tabs 19 have a length, as measured along the connection to the outer edge 13*b*, approximately equal to the length of outer edge 13*b* and a width of about 1 to about 2½ inches. However, the support tabs 19 also can suitably have shorter or longer widths and shorter lengths. Also, the shape of the support tabs 19 is not critical. Preferably, the support tabs 19 have a generally rectangular or a generally trapezoidal shape, especially a trapezoidal shape, as in FIG. 1. However, other support tab configurations also can be suitably employed.

Essential to the proper functioning of the support tabs 19 in the blank 10 is the connection of each support tab 19 to the edge 13*b* of an end wall panel 13. The connection between each support tab 19 and an end wall panel 13 must be adapted so that the support tab 19 can be folded precisely about the edge 13*b* merely by bending the support tab 19 relative to the end wall panel 13. The connection between the support tab 19 and the end wall panel 13 also must be adapted so that considerable resistance is encountered in folding the support tab 19 to an angle less than about 90° with respect to the end wall panel 13.

Hence, it is preferred that a cut fold line, generally 20, be provided between each support tab 19 and the end wall panel 13 to which it is connected. The cut fold line 20 can comprise a series of spaced straight knife cuts or slits 21, through blank 10, between each support tab 19 and an end wall panel 13. In the cut fold lines 20 of this application, the length of the cuts 21 is not critical. Preferably, the cut fold lines 20 between the support tabs 19 and the end wall panels 13 are scored between cuts 21 to promote folding of the support tabs 19.

As shown in FIG. 1, a particularly preferred arrangement of cuts 21 in a cut fold line 20 along the outer edge 13*b* of each end wall panel 13 is provided by using a plurality of cuts 21, each having about the same length, e.g., ¼ to 1 inch, preferably ½ to 1 inch, separated by straight scored portions 22 having the same length as the cuts 21, e.g., ¼ to 1 inch, preferably ½ to 1 inch. However, if desired the cut fold lines 20 between the support tabs 19 and the end wall panels 13 can suitably comprise a series of spaced cuts, with the spaces between the cuts not being scored or weakened in any other way. In such cut fold lines 20, the distances between the cuts 21 preferably are equal to or less than the lengths of the cuts 21.

The support tabs 19 are uniquely adapted to allow the side closure flaps 16 to be adhesively bonded to the end closure flaps 17 and to each other when closing the box 30 formed from the blank 10. The interaction of the support tabs 19 and closure flaps 16 and 17 will be discussed below.

In the blank 10, any conventional, strong and rigid, water resistant, paperboard material can be utilized. Preferably, the blank 10 is made from a single wall corrugated board having the flutes of the medium running parallel to the edges 11*b* of the bottom panel 11, connected to the end wall panels 13. A suitable corrugated board useful in the blank 10 has a burst strength of about 250 to 275 pounds per square inch, a basis weight of 146 to 178 pounds per 1,000 square feet, and moisture resistant medium and liners.

Also provided in blank 10 are strips of hot melt adhesive 23. The hot melt strips 23 are provided on the side wall panels 12 and on the end wall reinforcing flaps 14. The hot melt strips 23 preferably extend in a direction parallel to the edges 11*a* of the bottom panel 11, connected to the side wall panels 12. The hot melt strips 23 extend over only a portion of the length of side wall panels 12, as measured along the edges 11*a* of the bottom panel, but preferably extend along the entire length of the end wall reinforcing flaps 14, as measured transverse of the lateral edges 12*a* of the side wall panels 12, connected to the end wall reinforcing flaps 14.

The hot melt strips 23 are formed from conventional hot melt adhesive materials and can be applied in a conventional manner to the blank 10. The hot melt strips 23 are adapted to bond the side wall panels 12 to the side wall reinforcing flaps 15 and to bond the end wall reinforcing flaps 14 to the end wall panels 13 in assembling the open box 30 from blank 10.

Further provided in blank 10 are hand hole cut-outs 24 in the end wall panels 13 and end wall reinforcing flap 14. The hand hole cut-outs 24 are adapted to enable the box formed from blank 10 to be grasped through the end wall panels 13 and end wall reinforcing flaps 14.

Assembly of the open box 30 from blank 10 is shown in FIGS. 2 to 5.

Figure 2:
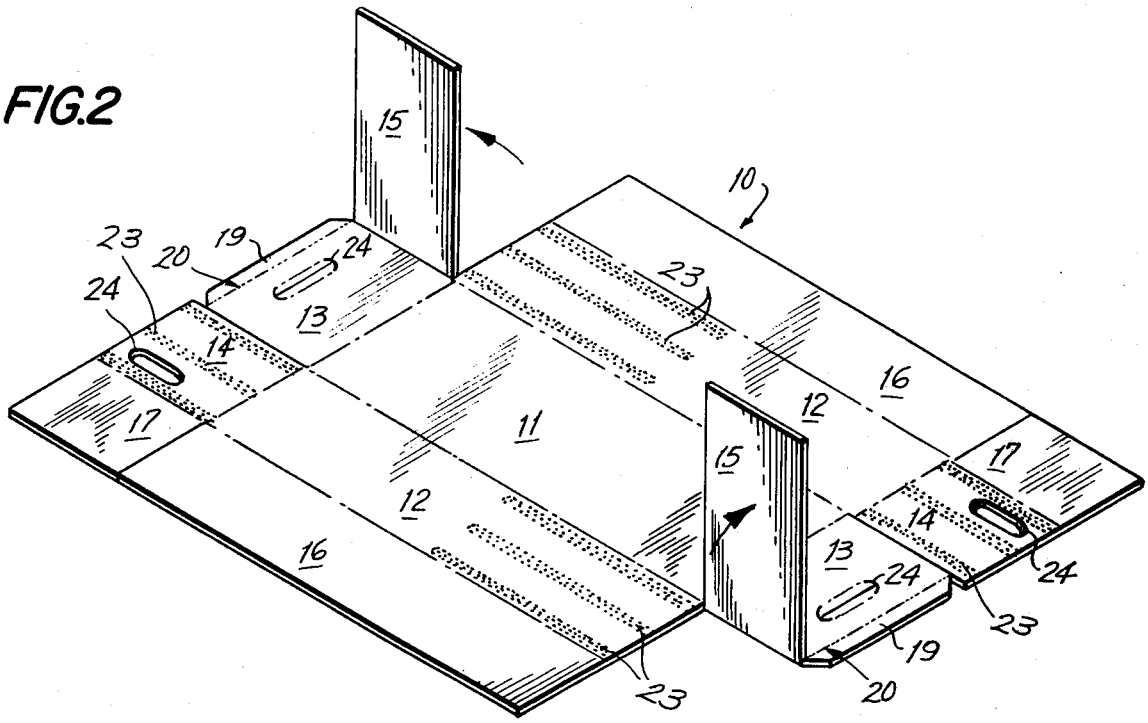
FIGS. 2–5 are perspective views showing the assembly of the open box from the blank.

As seen in FIG. 2, the first step in assembling the box 30 from the blank 10 preferably involves folding the pair of side wall reinforcing flaps 15 to a position perpendicular to the end wall panels 13. It is preferred that, during this step, the end wall panels 13 and the other elements of the blank 10 be substantially horizontal, with the exception of the side wall reinforcing flaps 15.

Figure 3:
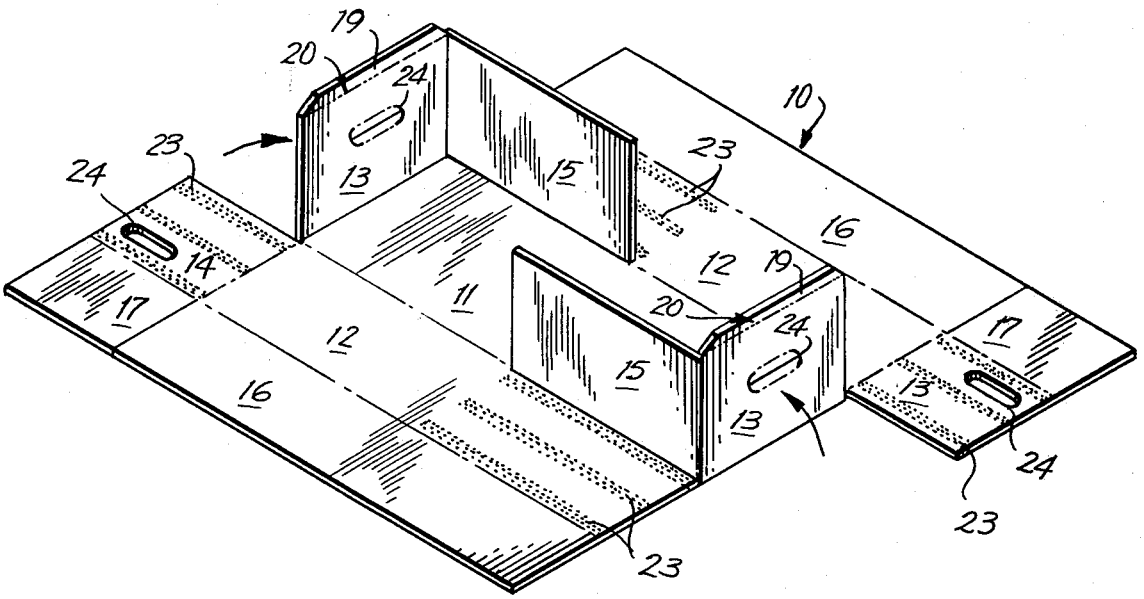

As seen in FIG. 3, the subsequent step in assembling the open box 30 preferably involves folding the end wall panels 13 so that they are perpendicular to the bottom panel 11. By folding the end wall panels 13 in this way, the side wall reinforcing flaps 15 are disposed perpendicular to the side wall panels 12 and bottom panel 11. It is preferred that, during this step, the elements of blank 10 be substantially horizontal, except for side wall reinforcing flaps 15 and end walls 13.

Figure 4:
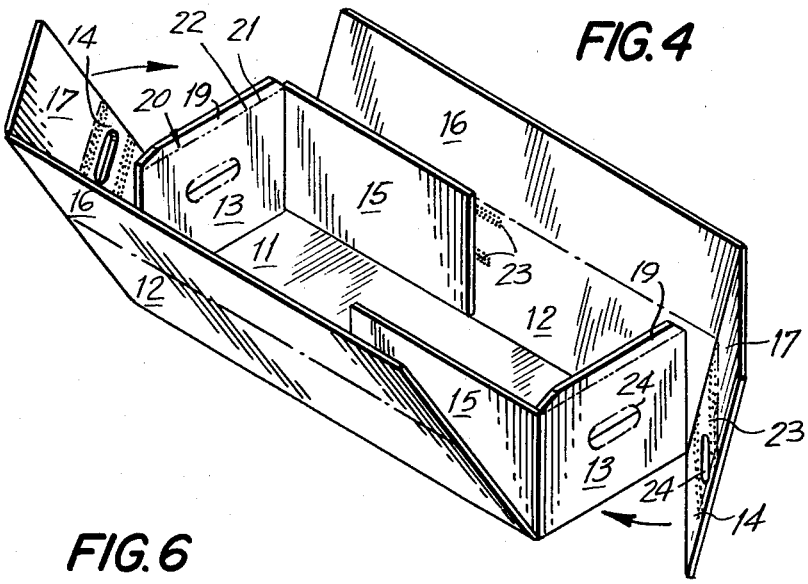
Figure 5:
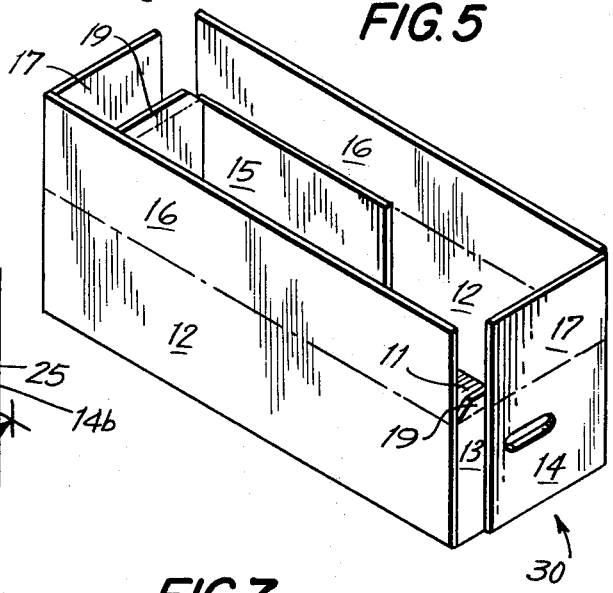

As seen in FIGS. 4 and 5, the last steps in setting-up open box 30 from blank 10 preferably involve: folding the side wall panels 12 so that they are substantially perpendicular to the bottom panel 11 and are pressed into face to face contact with the side wall reinforcing flaps 15; and then, folding the end wall reinforcing flaps 14 so that they are substantially perpendicular to bottom panel 11 and are pressed into face to face contact with the end wall panels 13. By these two steps, the upstanding side wall panels 12 and side wall reinforcing flaps 15 are adhesively bonded together, under pressure, by means of the strips 23 of hot melt adhesive. Also by these steps, the upstanding end wall panels 13 and end wall reinforcing flaps 14 are adhesively bonded together, under pressure, using the strips of hot melt adhesive. Formed thereby is the open box 30 of this application.

It should be noted that, in assembling box 30, as shown in FIGS. 1–5, the end wall reinforcing flaps 14 are preferably positioned outwardly of the end wall panels 13 and the box 30. Also in assembling box 30, the side wall reinforcing flaps 15 are preferably positioned inwardly of the side wall panels 12 and box 30. This preferred arrangement of end and side flaps and panels in box 30 can be utilized where, as in blank 10: the support tabs 19 are connected to outer edges **13*b* of the end wall panels 13 along the fold line containing cuts 21; the end closure flaps 17 are connected to outer edges 14*a* of the end wall reinforcing flaps 14; and the adhesive strips 23 are provided on the end wall reinforcing flaps 14 and the side wall panels 12**.

However, in accordance with an alternative embodiment of box 30 of this invention (not shown), the end wall reinforcing flaps 14 are positioned inwardly of the end wall panels 13 and box 30. In such an alternative box 30, the support tabs 19 are connected to outer edges **14*a* of the end wall reinforcing flaps 14 along a cut fold line and the end closure flaps 17 are connected to outer edges 13*b* of the end wall panels 13. In the alternative box, the support tabs 19 and the cut fold lines 20 connecting them to end wall reinforcing flaps 14 can have dimensions and configurations corresponding to those utilized in the blank 10 and box 30 of FIGS. 1–5. Also in such a box, the adhesive strips 23 are preferably provided on the end wall panels 13 and not on the end wall reinforcing flaps 14**.

Also in accordance with an alternative embodiment of the box 30 of this invention (not shown), the side wall panels 12 are positioned inwardly of the side wall reinforcing flaps 15 and box 30. In such an alternative box, the adhesive strips 23 are preferably provided on the side wall reinforcing flaps 15 and not on the side wall panels 12.

As shown in FIG. 5, the box 30 is open at the top. In this condition it can be readily filled with cut-up meat and the like. As can be seen from FIG. 5, the side and end closure flaps 16 and 17, as well as the support tabs 19, are upstanding, relative to the bottom panel 11 of the box. Hence, they are out of the way and cannot interfere with the filling of the box 30.

Figure 6:
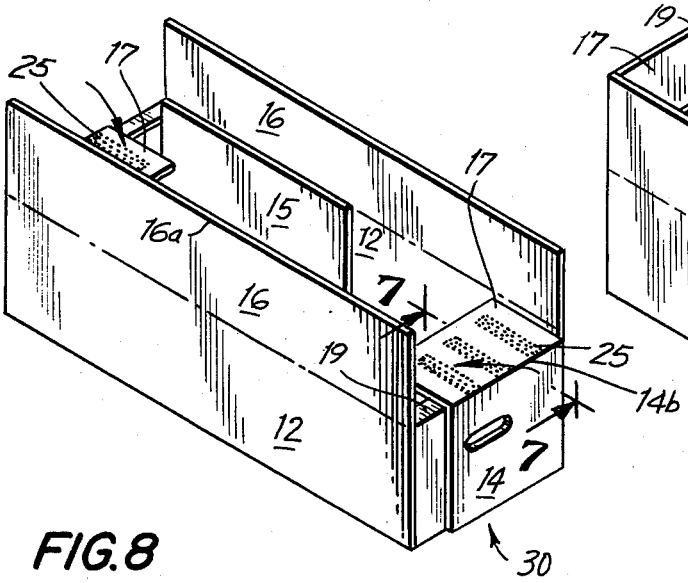
FIG. 6 is a perspective view of the partially closed box.
Figure 7:
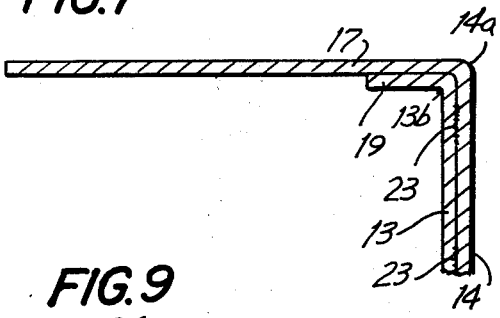
FIG. 7 is a sectional view taken along line 7—7 in FIG. 6.

Shown in FIGS. 6 and 7 are the first steps in closing box 30, after the box 30 is filled. These steps involve initially folding the end closure flaps 17 inwardly and downwardly of the box 30, about the fold lines 18 between the end closure flaps 17 and the end wall reinforcing flaps 14 (or the end wall panels 13 in the alternative embodiment of box 30). As the end closure flaps 17 are folded inwardly and downwardly of the box, as by pushing the end closure flaps 17 inwardly of the box, the support tabs 19 also are folded inwardly and downwardly of the box. The use of the cut fold lines 20 assures that, in this step: the support tabs 19 fold cleanly about the outer upper end wall panel edges **13*b* (or the outer upper end wall reinforcing flap edges 14*a* in the alternative box 30); and the tabs 19 fold to a position substantially perpendicular to the end wall panels 13 but do not extend substantially below the end wall panel edges 13*b*. As seen in FIG. 7, the step of folding the end closure flaps 17 inwardly and downwardly of the box results in the support tabs 19 underlying the end closure flaps 17 and being disposed, along with the closure flaps 17, substantially perpendicular to the end wall panels 13. Subsequently, additional strips 25 of hot melt adhesive are applied to the outer upper surfaces of the end closure flaps 17, adjacent to the edges 14*a* of the end wall reinforcing flaps 14**.

Figure 9:
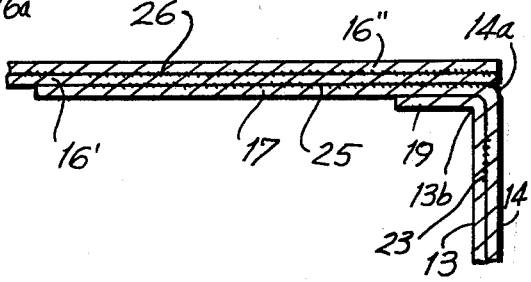
FIG. 9 is a sectional view taken along line 9—9 in FIG. 8.

Shown in FIGS. 8 and 9 are the last steps in closing box 30 to form the closed reinforced box 40 of this application. When box 40 is closed, it can suitably contain relatively large and heavy pieces of cut-up meat which may or may not completely fill the box.

The open box 30 is closed by folding one of the side closure flaps 16' inwardly and downwardly of the box, preferably to a position substantially perpendicular to the side wall panels 12. Then, a further additional strip 26 of hot melt adhesive is applied to the upper surface of the one folded-in side closure flap 16' along its edge **16*a* remote from the adjacent side wall panel 12. Subsequently, the other side closure flap 16'' is folded inwardly and downwardly of the box 30 so that it overlies the side closure flap 16'. The two side closure flaps 16' and 16'' then are pressed downwardly a limited distance, preferably by a steel platen which covers both side closure flaps 16. Pressing the side closure flaps 16 downwardly provides sufficient pressure between the side closure flaps 16 and end closure flaps 17 to adhesively bond the side closure flaps 16 to the underlying portions of the end closure flaps 17 with the adhesive in strips 25. Downwardly pressing the side closure flaps 16 also bonds the overlapping edge portions of the side closure flaps 16 with the adhesive in strip 26**.

That simply pressing the side closure flaps 16 downwardly provides sufficient pressure to adhesively bond all of the end closure flaps 16 and 17 together is the result of utilizing the support tabs 19. The supports tabs 19 restrain somewhat the end closure flaps 17 and thereby the overlying side closure flaps 16 from folding further inwardly and downwardly of the open box 30 when the side closure flaps 16 are pressed downwardly to close the box. The effect of the support tabs 19 upon the side and end closure flaps 16 and 17 is to hold them substantially perpendicular to the side and end walls 12 and 13 while the side closure flaps 16 are being pressed downwardly to close the box 30. Were such backing not provided by the support tabs 19, it is considered quite unlikely that merely pressing the side closure flaps 16 downwardly would provide sufficient pressure between the closure flaps 16 and 17 to reliably form an effective adhesive bond between the side closure flaps 16 and between the side and end closure flaps 16 and 17. However, the beneficial supportive effects of the support tabs 19 are obtained in box 40 simply by connecting such tabs along cut fold lines 20 to either end wall panels 13, along the upper edges **13*b* thereof, in accordance with the preferred embodiment of this invention, or to end wall reinforcing flaps 14, along the upper edges 14*a*** thereof, in accordance with an alternative embodiment of this invention.

That sufficient backing to adhesively bond the closure flaps 16 and 17 together is provided by the support tabs 19 of this application is particularly important when using the boxes 40 for relatively large sizes of cut-up meat, such as pork loins and pork butts. When such boxes are "filled" with large pieces of meat, the meat frequently does not extend to the top of the boxes, i.e., to the upper end wall panels edges **13*b*. As a result, the support tabs 19 are needed to hold up the closure flaps 16 and 17 when they are being pressed downwardly to close the box. Were such tabs 19 not provided in box 40, the closure flaps 16 and 17 could fold inwardly of the box and not be pressed together when the side closure flaps 16 were being depressed, and, thereby, instead of the strong adhesive bonds formed between closure flaps 16 and 17, weak adhesive bonds or no adhesive bonds would be formed between the closure flaps 16 and 17. Hence, the support tabs 19 help assure that all the packed boxes 40** produced in a large scale meat packing operation are satisfactory, i.e., adhesively closed, and ready for storage or shipment.

The box 40 shown in FIG. 8 is well adapted to be set-up, filled and closed on automatic equipment. The box also is adapted to be stored and shipped in a stack, after being filled and closed. The strength of the box is attributable to the use of reinforcing flaps 14 and 15 about the side and end wall panels 12 and 13 of the box, as well as to the fact that the flutes of corrugated material in the two layers of board about the sides and ends of the box run in a vertical direction in one layer and in a horizontal direction in the other layer.

In the ends of box 40, the double thickness of paperboard is particularly valuable for providing both stacking strength and strength of the container about the hand holes 24. The double thickness of paperboard reduces the danger that the container will be crushed when stacked or torn when the container is lifted or pulled by its hand holes.

The dimensions of the flaps and panels of the box 40 are not critical and can be varied to provide different size boxes having varying amounts of side and end wall reinforcement. In box 40 the upstanding side and end wall panels 12 and 13 and the upstanding reinforcing flaps 14 and 15 should have the same height. However, the end wall panels 13 and end wall reinforcing flaps 14 can have any lengths so long as they can be suitably overlapped and adhesively bonded and their end closure flaps 17 and support tabs 19 can be suitably overlapped. Preferably, the length of the end wall panels 13 is equal to or greater than the end wall reinforcing flaps 14. Similarly, the side wall reinforcing flaps 15 can have any length equal to or less than the side wall panels 12. Preferably, the side wall reinforcing flaps 15 have a length less than that of the side wall panels 12 but greater than one-half of the length of the side wall panels 12. On the other hand, if desired, the side wall reinforcing flaps 15 can have a very small length in comparison with the side wall panels 12. In such a case, the side wall reinforcing flaps 15 need only have a sufficient length to allow them to be adhesively bonded to the side wall panels 12 to form the box 40.

It is thought that the invention in many of its attendant advantages will be understood from the foregoing description and it will be apparent that various changes may be made in the form, construction and arrangement of the parts without departing from the spirit and scope of the invention or sacrificing all of its material advantages, the form hereinbefore described being merely a preferred embodiment.

I claim:

1. In a paperboard box for relatively large pieces of cut-up meat, that is adapted to be set-up, filled with meat and closed, using adhesive materials, on automatic equipment, that has reinforced side walls and end walls, and that is formed from: a generally rectangular, bottom panel (11); a pair of upstanding, generally rectangular, side wall panels (12), foldably connected to opposite edges of the bottom panel (11); a pair of upstanding, generally rectangular, end wall panels (13), foldably connected to opposite edges of the bottom panel (11); a pair of upstanding, generally rectangular, side wall reinforcing flaps (15), each foldably connected to an upstanding edge of one of the end wall panels (13) and located inwardly of and in face to face contact with one of the side wall panels (12); a pair of upstanding, generally rectangular, end wall reinforcing flaps (14), each foldably connected to an upstanding edge of one of the side wall panels (12) and located outwardly of and in face to face contact with one of the end wall panels (13); a pair of generally rectangular, side closure flaps (16), each foldably connected to the upper edge of one of the side wall panels (12) and disposed substantially perpendicular to the side wall panels (12); and a pair of generally rectangular, end closure flaps (17), each foldably connected to the upper edge of an end wall reinforcing flap (14) and disposed substantially perpendicular to the end wall panels (13); the improvement which comprises:

a pair of support tabs (19), each underlying one of the end closure flaps (17) and the pair of side closure flaps (16) and each having disposed substantially perpendicular to the end wall panels (13) along a cut and scored fold line (20) between the upper edge of each end wall panel (13) and each support tab (19).

2. The box of claim 1 wherein the cut and scored fold line comprises a plurality of cuts of about the same length separated by scores having about the same length as the cuts.

3. The box of claim 2 wherein each cut has a length of about ½ inch to about 1 inch.

* * * * *